US006601986B2

(12) United States Patent
Jang et al.

(10) Patent No.: US 6,601,986 B2
(45) Date of Patent: Aug. 5, 2003

(54) FLUID MIXING APPARATUS

(75) Inventors: Ruei-Hung Jang, Shinjuang (TW); Tien-Hsing Woo, Taipei (TW); Chih-Lin Ying, Hsinchu (TW); Tsung-Chi Hsieh, Taipei (TW); Ming-Kuo Yu, Hsinchu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 23 days.

(21) Appl. No.: 09/941,532

(22) Filed: Aug. 29, 2001

(65) Prior Publication Data

US 2003/0043689 A1 Mar. 6, 2003

(51) Int. Cl.[7] ..... B04C 3/00; B01F 5/06
(52) U.S. Cl. ..... 366/165.2; 366/340
(58) Field of Search ..... 366/165.1, 165.2, 366/340, 336

(56) References Cited

U.S. PATENT DOCUMENTS 1,543,941 A * 6/1925 Mathesius ..... 261/111
2,080,616 A * 5/1937 Lynne et al. ..... 366/165.1
3,261,593 A * 7/1966 Sharples ..... 366/165.2
3,291,456 A * 12/1966 Deane ..... 366/165.1
3,306,587 A * 2/1967 Schroedter ..... 366/162.4
4,032,114 A * 6/1977 Kolm et al. ..... 366/165.2
4,108,732 A * 8/1978 Nuttall, Jr. ..... 366/165.2
4,215,081 A * 7/1980 Brooks ..... 366/165.1
4,415,275 A * 11/1983 Dietrich ..... 366/165.1
4,514,095 A * 4/1985 Ehrfeld et al. ..... 366/340
5,887,977 A * 3/1999 Morikawa ..... 366/340
5,984,519 A * 11/1999 Onodera et al. ..... 366/165.2

* cited by examiner

*Primary Examiner*—Tony G. Soohoo
(74) *Attorney, Agent, or Firm*—Tung & Associates

(57) ABSTRACT

A static mixer comprises a mixing chamber with an inlet mixing module, fluids to be mixed being fed into the module to undergo swirling and jet collision, at least one intermediate mixing module connected to the inlet mixing module and provided with means for splitting liquid flow into a plurality of jet flows with subsequent recombination of said jets and mixing action of vortices formed around the jet flows, and an outlet mixing module connected to the intermediate mixing module and provided with means for further swirling premixed fluids.

18 Claims, 6 Drawing Sheets

FLUID MIXING APPARATUS

BACKGROUND OF THE INVENTION

1. Field of the Invention

The present invention relates in general to methods of static liquid mixing and more particularly to static mixing of liquid systems comprising a carrier fluid and one or more diluents. Such methods of mixing are most suitable for applications in semiconductor industry for dilution or concentration of etching, cleaning, or polishing solutions in semiconductor wafer fabrication.

2. Prior Art

Fluid mixing is employed in numerous applications with the goal to achieve uniformity of various physical and chemical properties such as density, temperature, viscosity, concentration, etc.

Fluid mixing could be accomplished by various methods. These methods may be broken down into three major categories: 1) mechanical agitation; 2) gas bubbling; and 3) static mixing.

Mechanical agitation involves usage of moving parts and therefore the reliability of devices that utilize it is inferior to that of devices utilizing static mixing methods.

Bubbling gases through liquids does not provide uniformity of mixed fluid parameters that could be achieved by other mixing methods.

The present invention relates to static mixing methods and devices. State of the art in static mixing is taught in Chemical Engineering courses, see for example chapter on static mixers in CHEMICAL ENGINEERING by J. M. Coulson and J. F. Richardson with J. R. Backhurst and J. H. Harker, Sixth Edition, Butterworth-Heinemann Publishing House, December 1999, volume 1, pp. 307–310. There, numerous static mixers are described comprising stationary helical blades contained within a pipe. Various combinations of lattices placed within a pipe are also described. Helical blades and lattices serve for cutting and twisting the flow to achieve better mixing. Multiple divisions and recombinations of fluid flow within a static mixer containing the above-mentioned elements (blades and/or lattices) secure homogenous mixing. Identified in that teaching are the most important characteristics of static mixing, namely a) mixing quality measured by the ratio of the standard deviation in fluid composition at a certain stage of mixing to the standard deviation at the mixer inlet; b) pressure drop factor measured by the ratio of pressure drop in a pipe without static mixing elements to the pressure drop in the same pipe but with static mixing elements, c) initial cost, and d) convenience of installation and easy maintenance.

A static mixing device, comprising a plurality of chambers, each chamber having an inlet and an outlet located in the opposite ends of a chamber displaced 180 degrees from each other, is described in U.S. Pat. No. 4,534,659 for "Passive fluid mixing system" issued to Theodore A. Dourdeville and Anthony Lymneos. This simple design could provide low initial cost, low maintenance cost, and low pressure drop, but good mixing quality is difficult to achieve utilizing this device.

In U.S. Pat. No. 4,753,535 for "Motionless mixer" issued to Tony King, a static mixer is disclosed comprising axially overlapping mixing elements that induce counter-rotational angular velocities relative to the axial velocity of moving liquids. This design may contribute to undesirable increase in pressure drop.

In U.S. Pat. No. 5,137,369 for "Static mixing device" issued to John Hodan, a static mixing device is described comprising a stacked arrangement of plates, the latter having channels that split flow of liquid and guide it in the direction generally normal to the primary direction of flow. The mixer is modular in a sense that it comprises a plurality of those plates to achieve the desired mixing effect. The disadvantage of the design lays in high pressure drop and elevated maintenance cost because the above channels should be periodically cleaned to secure consistent mixing quality throughout the operating life of the apparatus.

In U.S. Pat. No. 5,843,385 for "Plate-type chemical reactor" issued to Jeffrey Dugan, a reactor is described, in which static mixing is achieved by a plurality of serially joined chambers containing flow-splitting means. The device is easy to maintain. However, thoroughness of mixing in some applications could turn out to be inadequate.

In U.S. Pat. No. 5,863,129 for "Serial resin mixing devices" issued to Gary Smith, a disclosure is made to a family of inexpensive, easy to manufacture and easy to maintain static mixing devices, in which a multi-component liquid system flows through an elongated mixing chamber, the latter containing cylindrical mixing elements. This device is most suitable for such applications as mixing within spray guns or the like.

In U.S. Pat. No. 5,984,519 for "Fine particle producing devices" issued to Tadao Onodera et al., a device is disclosed where fluid flows through channels forming multiple high-speed streams, the streams colliding with each other creating pockets of turbulence. The device is claimed to be applicable only to conditions where high pressure could be applied to the fluid system.

In U.S. Pat. No. 6,000,418 for "Integrated dynamic fluid mixing apparatus and method" issued to Frederick Kern and William Syverson, a static mixer is described. The purpose of this mixer is to provide mixing means ensuring uniformity of cleaning and etching solutions used in semiconductor industry in the fabrication of integrated circuits on semiconductor wafers. The patented mixer employs multi-port venturi injectors. Such injectors provide easy to maintain and very accurate means of injecting required volumes of liquid chemicals into flow of carrier fluid. Using venturis generally entails higher power consumption if compared with mixers employing only static mixing elements.

A static mixing device comprising a plurality of axially extended helically twisted blades and impact bearing flat surfaces placed within a pipe is disclosed in U.S. Pat. No. 6,164,813 for "Static fluid mixing device with helically twisted elements" issued to Chiang-Ming Wang et al. The disadvantage of this device is in using the axial direction for static mixing, which does not allow proper usage of volume of the device, increasing pressure drop, as well as initial cost and maintenance cost.

It is to be understood that though known static mixers including those described above are very much suitable for their respective intended purposes, they do not achieve simultaneously consistent high quality mixing, low pressure drop, small initial capital investment, and easy maintainability, particularly in the applications related but not limited to thorough mixing of cleaning, etching, and polishing liquids used in semiconductor wafer manufacturing.

SUMMARY OF THE INVENTION

Therefore, an object of the present invention is to provide excellent quality of mixing by reducing the ratio of standard deviation of liquid system component characteristic such as concentration of a certain component in multi-component fluid system at the outlet of the static mixer to that at the inlet to the values close to zero. The exact value of the ratio depends upon a specific application.

Another object of the present invention is to provide as low pressure drop as possible for fluid components flowing through a mixer while maintaining high quality of mixing.

Yet another object of the present invention is to reduce the initial capital investment in manufacturing of the static mixer by means of simplifying and standardizing means used for dividing, cutting, and swirling flow of fluids being mixed.

Yet another object of the present invention is to substantially reduce maintenance costs by making modular means used for dividing, cutting, and swirling flow of fluids being mixed and having each mixing module easily cleanable.

One more object of the present invention is to make static mixer easy to assemble and disassemble.

Still one more object of the present invention is to provide means of static mixing suitable for fluid systems comprising Newtonian liquids, such as deionized high purity water, and Non-Newtonian fluids, more particularly pseudoplastic fluids such as slurries and some polymer solutions. Those skilled in the art appreciate that Newtonian fluids start to flow immediately after the pressure is applied and their strain is proportional to the stress, whereas pseudoplastic fluids start flowing only after stress exceeds a certain threshold value, and then their strain is proportional to the stress.

Yet another object of the present invention is to provide means of static mixing for Newtonian and Non-Newtonian fluids or their combination, particularly for purely viscous Non-Newtonian fluids as e.g. some polymer solutions like solution of carboxymethylcellulose in water. Purely viscous fluids start to flow immediately after pressure has been applied like Newtonian fluids, but unlike Newtonian fluids they have strain non-linearly dependent on stress.

Still another object of the present invention is to provide means of static mixing for suspensions whether Newtonian or Non-Newtonian or their combination.

Yet another object of the present invention is to provide means of uniformity control by means of static mixing for fluid systems employed in cleaning, etching, and polishing of surfaces of computer processing units and memory elements such as semiconductor wafers and compact disks, said means being inexpensive, easy to install, easily maintainable, and secure low pressure drop.

The above and other objects, features, and advantages of the invention are achieved by a static mixer that includes but not limited to a plurality of standardized mixing modules encased within a column where mixing takes place.

Those mixing modules create corresponding mixing zones within the column. In their entirety, the mixing zones provide excellent quality of mixing while keeping pressure drop low. In each mixing module static mixing elements are manufactured with a goal of achieving easy assembly and with another goal of avoiding stagnant fluid zones to avoid particulate sedimentation said avoidance of stagnant fluid zones increasing periods between cleanings.

The inlet mixing module has a chamber that consists of inlet means, outlet means, and an inlet mixing head, the inlet mixing head comprising a conical distributor placed in the center of the head, the distributor having a set of curved chutes and a set of curvilinear vanes extending from the bottom of said distributor in the direction of inner walls of the chamber. Fluid moving along the vanes acquires tangential component to its velocity. Another fluid is introduced into the chamber via tangential pairs of inlet conduits, each pair of the conduits being offset by 180°. The conduits are either manufactured together with the main body of the chamber by e.g. sheet metal forming, forging, or melting, or connected to the body of the chamber by welding or by any other suitable means. The conduits provide acceleration to the second fluid having their cross-sections decreased from inlet section inward. The direction of flow out of the conduits is close to normal relative to the direction of the flow of the first fluid created by the vanes and exiting into the chamber by means of a plurality of branch pipes. This arrangement causes vigorous mixing within the inlet mixing module dividing and cutting portions of both fluids and dissipating vortices by means of the swirling action.

Intermediate mixing module is generally placed downstream from the inlet mixing module. This module consists of at least one plate having a plurality of orifices and/or channels drilled or otherwise machined, the orifices and/or channels splitting flow of fluid premixed by the inlet mixing module. The orifices and/or channels form jets that promote mixing in the flow of mixture directed downward from the plate. The intermediate mixing module could comprise stacks of plates, each plate having orifices and/or channels drilled or otherwise machined in such a way as to offset them from plate to plate causing jet impingement upon the lower plate, which further enhances mixing.

The outlet mixing module is placed at the bottom end of the column. This mixing module comprises inlet means, outlet means, and a chamber, the chamber comprising an outlet mixing head that is very much similar to the mixing head employed in the inlet mixing module. It also comprises a conical distributor in its center and a set of curvilinear vanes extending from the bottom of that distributor in the direction of inner walls of the chamber. The outlet mixing module lacks conduits present in the inlet mixing module. The conduits have been used in the inlet mixing module for initial mixing of two fluids entering the column through respective inlet ports. Because the outlet mixing module is employed for further mixing of the already premixed fluid system, there is no need anymore for such conduits. The curvilinear vanes employed in the outlet mixing module are similar to, but not exactly the same as the vanes employed in the inlet mixing module. The vanes of the outlet mixing module might have different angle distribution along the vane if compared with the vanes of the inlet mixing module because they enhance mixing of the already premixed fluid system, while the vanes of the inlet mixing module should be able to sustain vigorous mixing at the initial stage of fluids entering the column. Also, the number of vanes could be different in inlet and outlet mixing heads. However, the similarity of design of the heads belonging to the inlet and to the outlet mixing modules is certainly an advantage because it facilitates assembling, disassembling, and cleaning operations.

The present invention is not limited to the usage of three mixing modules. The number of mixing modules could be less or more depending on the circumstances of the mixing process. The intermediate mixing module comprising at least one plate with orifices and/or channels could be installed repeatedly along the column to achieve desired mixing of components of the fluid system. The outlet mixing module also could be installed not only at the outlet portion of the column as described above, but also in various cross-sections of the middle part of the column to further enhance mixing. Moreover, columns could be interconnected providing even more thorough mixing.

BRIEF DESCRIPTION OF THE DRAWINGS

The present invention will be described in much more detail hereinafter using drawings of preferable embodiments of the invention. This invention, however, is not limited by the specific embodiments. Full set of features and advantages of the invention will become clear to those skilled in the art from the following description when considered in conjunction with accompanying drawings, in which.

DETAILED DESCRIPTION OF THE PREFERRED EMBODIMENTS OF THE INVENTION

Figure 1:
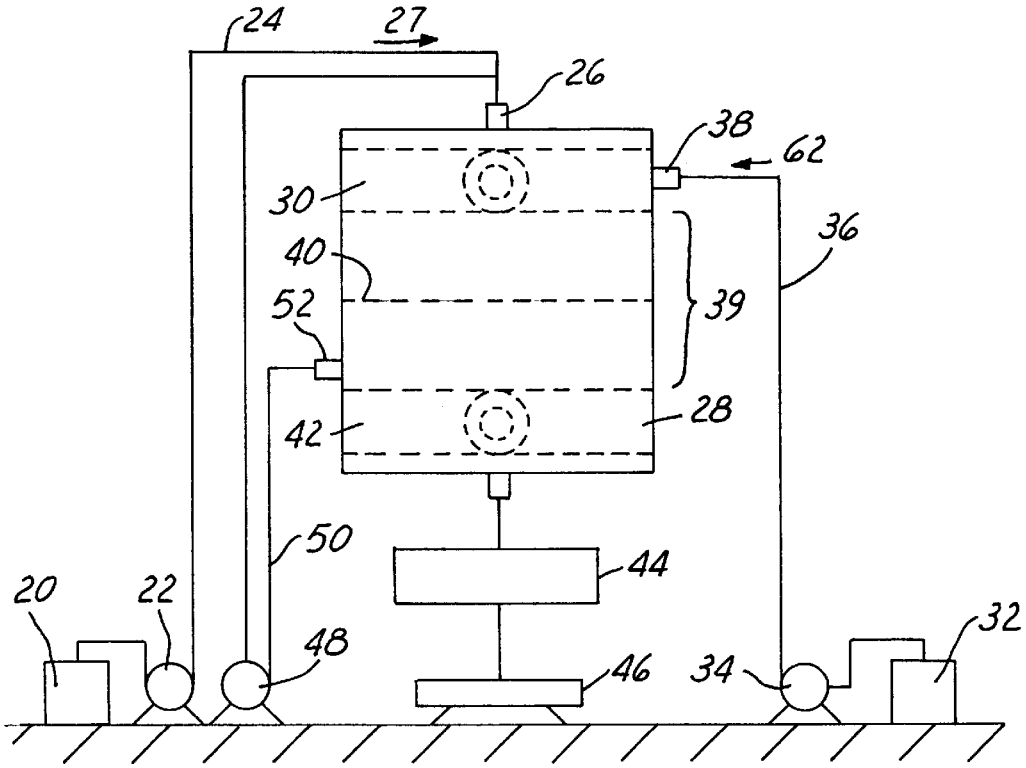
FIG. 1 is a schematic diagram showing a mixing column together with associated elements and illustrating flows of fluids.

A typical system for fluid mixing according to the present invention is diagrammatically represented in FIG. 1. A fluid 27 is fed from a reservoir 20 by a pump 22 via a pipe 24 into a feeding inlet conduit 26 of a main mixing column 28, from which conduit it flows into an inlet mixing module 30 where it mixes with another fluid 62 fed from a reservoir 32 by means of a pump 34 via a pipe 36 through another inlet conduit 38. As will be explained below in more detail, there can be more than one inlet conduit 38. In the inlet mixing module 30, both fluids undergo vigorous mixing by numerous mixing mechanisms, which include, but not limited to flow momentum dissipation, the latter due to fluid swirling and fluid jets collisions creating eddies and vortices.

From the inlet mixing module 30, premixed fluids continue to flow either by gravity or under applied pressure to a middle section 39 where an intermediate mixing module 40 is placed. Here, premixed fluids undergo further mixing governed by other mechanisms than those, which have been prevalent in the inlet mixing module 30. In the intermediate module 40, mixing is accomplished mainly by means of splitting liquid flow into a plurality of jets, subsequent recombination of said jets, and mixing action of vortices formed around the jets.

From the intermediate mixing module 40, the premixed fluids proceed into an outlet mixing module 42 where they undergo so called "fine tuning" mixing preparing them for delivery in a condition most perfectly fitted for the operation they have been mixed for. In the outlet module 42, mixing mechanisms are essentially the same as in the inlet module 30 with the exclusion of collisions between incoming fluids.

Finally, mixed fluids move under gravity or under applied pressure to a collector 44, from which they are directed into a processor 46 or to a multiplicity of such processors.

In a typical embodiment of the present invention, a part of the fluids being mixed is returned for additional mixing by means of a recirculation pump 48, the latter directing fluids, received via a pipe 50 from a recirculation outlet 52 located in a zone below the intermediate mixing module 40, back to the feeding inlet conduit 26. The partial recirculation allows further improve the quality of mixing because a part of the fluid that has been already "fine tuned" undergoes mixing again.

Figure 2:
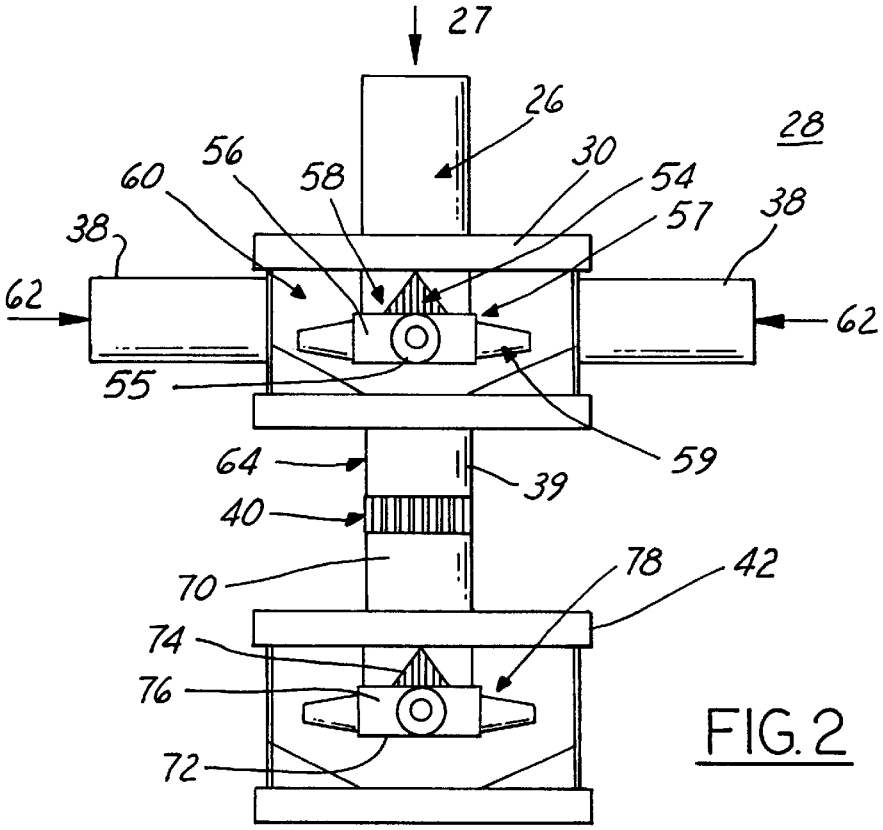
FIG. 2 is a vertical cross-sectional view of the preferred embodiment of the mixing column comprising an inlet mixing module, an intermediate mixing module, and an outlet mixing module.

As illustrated in FIG. 2, the preferred embodiment of the main mixing column 28 comprises the feeding inlet conduit 26 directing the fluid 27 with at least one component into the inlet mixing module 30 where it flows over a central conical distributor 54 along concave chutes (not shown) into spaces between curvilinear vanes 56 of a mixing head 57. The mixing head 57 comprises a disc 58 with tangential jets 59, through which the fluid 27 flows out of the spaces between the vanes 56. It goes into an inner chamber 60 of the inlet mixing module 30. There are two conduits 38 in this embodiment, through which conduits the other fluid 62 with at least one component is fed into the chamber 60. The conduits 38 are welded or otherwise attached to the inlet mixing module 30.

Velocity of the fluid 62 coming into the chamber 60 from conduits 38 has tangential and radial components. The tangential component of the fluid velocity causes it to swirl inside the chamber 60 while the radial component of the same velocity promotes collisions with portions of fluid coming out of the spaces between vanes 56 through jets 59. Both mechanisms lead to intensive and high-shear mixing.

The control over mixing quality and pressure drop in the chamber 60 is accomplished by proper selection of such characteristics as number and curvature angles of the vanes 56 and number, size, and angle of entry of feeding conduits 38. It is well known to those skilled in the art that selection of those characteristics is quite different in laminar and in turbulent flows of flow.

The flow is determined by computation of Reynolds Number, which includes fluid viscosity, chamber size, and velocity. In the art, flow is determined usually by the value of fluid viscosity. At viscosities lower than 10 N sec./$m^2$, flow generally is considered turbulent, otherwise it is laminar. In the turbulent flow, eddy diffusion substantially helps achieve high quality of mixing, while in the laminar flow one has to rely mainly on molecular diffusion and extension and elongation of portions of the fluid. On the other hand, faster homogenization of the fluids in the turbulent flow, though producing more rapid mixing, requires higher pressures and consequently higher power consumption in comparison with the laminar flow.

From the inlet mixing module 30, premixed fluids move downward into an upper part 64 of the middle section 39 of the main mixing column 28. In the preferred embodiment illustrated in FIG. 2, the diameter of the upper part 64 of the middle section 39 is smaller than that of the inlet mixing module 30. The purpose of that is to accelerate fluid flow before entering the intermediate mixing module 40. However, this arrangement is not necessary for all applications. For example, in some applications the column is not divided into sections but serves as a container for mixing modules, the column diameter being the same throughout its length. Such an arrangement facilitates assembly, disassembly, and cleaning of the column.

The intermediate mixing module 40 in FIG. 2 comprises at least one plate (not shown) with orifices for dividing fluid flow into jets to enhance mixing. The number of plates, their thickness, form of holes drilled or otherwise machined in each plate, and plate arrangement could be quite different depending on the flow and the application, which the mixing is performed for.

The particular embodiment depicted in FIG. 2 is designed based on the stipulation that flow is turbulent and fluids are either Newtonian or non-Newtonian with the exclusion of two classes of non-Newtonian fluids, namely visco-elastic or elasto-viscous non-Newtonian fluids.

In the turbulent flow of Newtonian fluids, a contraction occurs in an orifice. This contraction causes vortices to occur around a jet coming out of an orifice, the vortices greatly enhancing the speed of mixing that leads to higher mixing quality but requires higher pressure drop than that the column would experience if there were no intermediate mixing module.

There is no contraction of fluid flow if it is the laminar flow. In two classes of non-Newtonian fluids, namely visco-elastic and elasto-viscous fluids, after leaving an orifice, fluids do not contract but swell. Vortices are not formed around a swollen jet coming out of orifices so this configuration is not applicable to these classes of non-Newtonian fluids.

After the intermediate mixing module 40, the fluid mixture flows through a lower part 70 of the middle section 39 to an outlet mixing module 42. In the discussed embodiment, the diameter of the lower part 70 of the middle section 39 of the main mixing column 28 is made equal to that of the plate of the intermediate mixing module 40 and the upper part 64 of the middle section 39. This is done to accommodate easier assembly and cleaning of the main column. However, in other applications, where premixing after the intermediate module 40 is insufficient, the diameter of the lower part 70 could be made less than that of the intermediate module providing fluid acceleration.

In the outlet mixing module 42, a mixing head 72 is installed. It comprises a central conical distributor 74, a plurality of curvilinear vanes 76, and a plurality of jets 78. In this embodiment of the present invention, the outlet mixing module 42 is similar to the inlet mixing module 30. The standardization of mixing module design is an essential feature of the present invention. It greatly facilitates manufacturing of the static mixing device and reducing the initial cost and also makes installation and maintenance much easier than in the case where the mixing heads are different.

The number of mixing modules can differ from the three shown in FIG. 2. Preferably, the number of modules should be multiple of 3. However, this number cannot be increased too much because of the pressure drop: the higher the number of modules, the larger is the pressure drop.

Figure 3A:
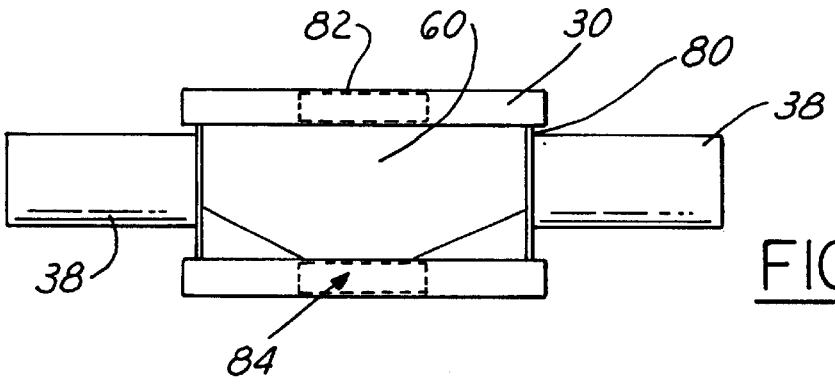
FIG. 3 presents vertical cross-sectional and top views of the inlet mixing chamber.
Figure 3B:
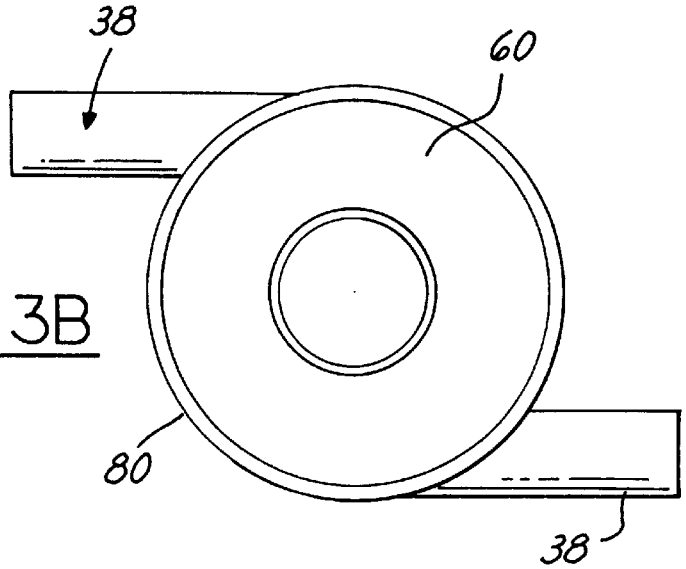
Figure 4A:
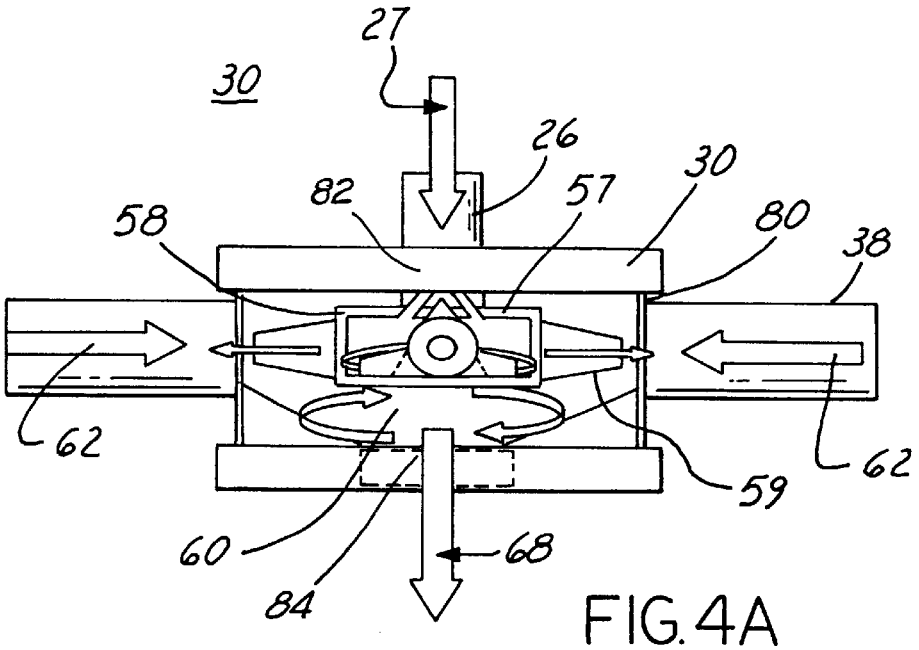
FIG. 4 presents more detailed vertical and top cross-sectional views of the same inlet mixing chamber, with arrows depicting various flow patterns existing inside the chamber.
Figure 4B:
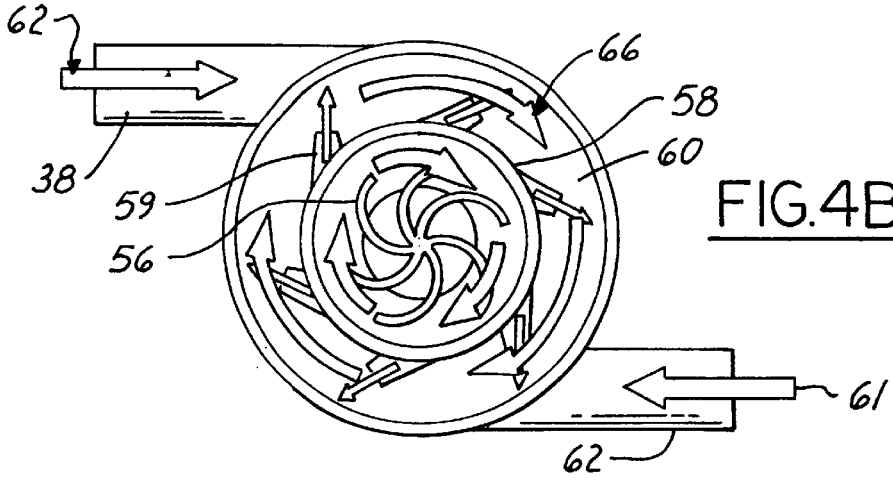

In FIG. 3 and FIG. 4, the preferred embodiment of the inlet mixing module 30 is presented in front and top views (FIGS. 3*a,* 4*a* and 3*b,* 4*b,* respectively), FIGS. 4*a,* 4*b* showing flow pattern in the module 30. The module comprises a main body 80 defining the chamber 60 with an inlet 82, an outlet 84, and two parallel conduits 38. The main body 80 and the conduits 38 could be manufactured as a whole by means of e.g. sheet metal forming, forging, or melting, or the conduits 38 could be machined into the main body 80 or the conduits 38 could be attached to the main body 80 by welding or any other suitable means.

The fluid 27 is fed through the inlet conduit 26 and the inlet 82. The other fluid 62 enters the module 30 through the two conduits 38 swirling around the chamber 60, the swirling motion shown by arrows 66 being induced by a tangential placement of the conduits 38 relative to the body 80. The number of conduits may vary from the two shown in FIGS. 3 and 4. One tangential conduit may be sufficient for certain applications. However, two parallel tangential conduits are more preferable than one conduit because they create two opposite streams inducing portions of entering fluid to collide and swirl, thus further enhancing mixing. A plurality of tangential conduits 38 can be employed to enhance swirling motion of the fluid. It is preferable to arrange multiple conduits in pairs creating within the chamber several areas of intense mixing where simultaneous collisions of swirling fluid portions take place.

The diameter of the outlet 84, from which a fluid mixture 68 is discharged, is smaller than the diameter of the main body 80 of the inlet mixing module 30, which is made to create a converging flow zone inside the module to accelerate the fluid being mixed, and to thus further enhance the quality of mixing. The ratio of the diameter of the outlet 84 to the diameter of the module's main body 80 is defined between 1:1.5 and 1:10, preferably 1:4. Direction baffles (not shown) could be installed within the chamber 60 directing flow from inside the chamber to the outlet and eliminating stagnant zones. The preferable profile of the baffle cross-section is a convex lemniscate but it can be any other smooth profile. However, the installation of the baffles may raise the initial cost of the mixer and introduce additional surfaces to be cleaned. At the same time, if stagnant zones are perceived to be the cause of inadequate mixing, baffles should be installed inside the chamber 60.

Figure 5A:
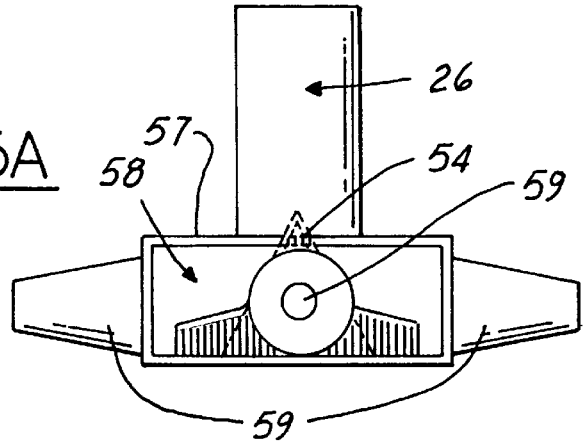
FIG. 5 presents a front view of the inlet mixing head, a cross-sectional top view, and an isometric projection of the central conical distributor the latter showing curved chutes in detail.
Figure 5B:
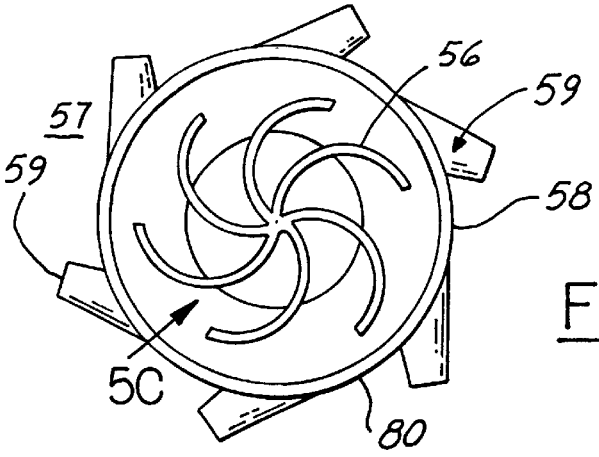
Figure 5C:
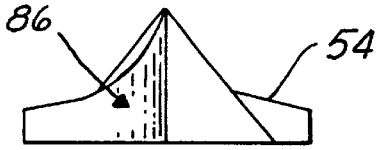
Figure 6A:
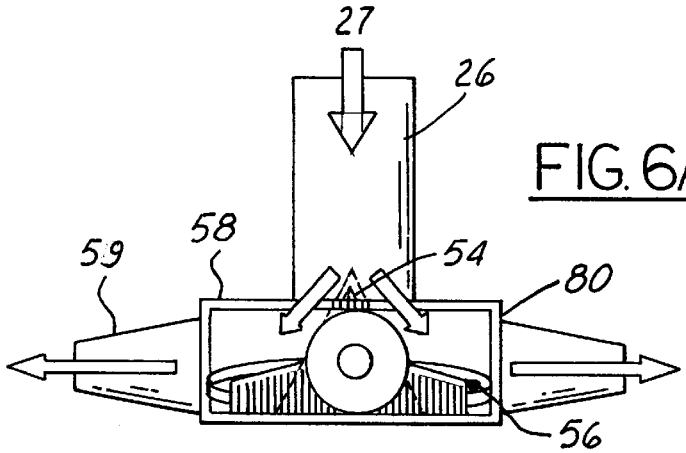
FIG. 6 presents more detailed vertical and top cross-sectional views of the same inlet mixing head together with arrows depicting various flow patterns existing inside the head.
Figure 6B:
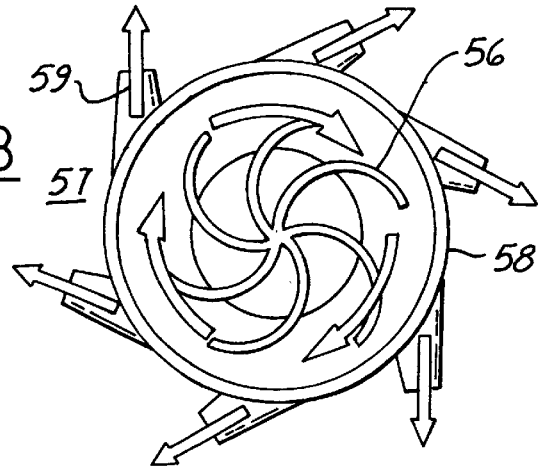

A preferred embodiment of the inlet mixing head is shown in FIG. 5 and FIG. 6 in front and top views (FIGS. 5*a,* 6*a* and 5*b,* 6*b,* respectively). Also, an isometric projection of the central conical distributor is shown in FIG. 5*c*.

The fluid 27 falls first onto a conical distributor 54. The distributor 54 comprises a plurality of concave chutes 86. The preferred chute profile is a concave lemniscate, however, any other smooth profile could be used provided it reduces the impingement of fluid onto the surface of the disc 58 of the main body 80 of the module between the vanes 56. The number of chutes 86 is equal to the number of spaces between vanes 56 the fluid is directed into.

The vanes 56 are either manufactured by sheet metal forming, forging, or melting together with the main body 80, or machined into the main body 80, or attached to it by any suitable means, e.g. welding. An entry angle of the vane closest to the distributor should be such that the fluid flowing downward from the chute be received without a shock. The angles along vane change continuously. They are determined by compounding the radial and the tangential components of the fluid velocity, the latter resulting from the fluid throughput and the required pressure drop.

Out of spaces between vanes, the fluid discharges through the jets 59. The latter are tangential to the main body 80 to provide an angular momentum that causes fluid to swirl. The tangential jets 59 are conical, the ratio of outlet to inlet diameters being between 1:1.5 and 1:15, preferably 1:6. The number of jets 59 is preferably equal to the number of spaces between vanes 56, however it could be more or less depending on the requirements to the value of tangential component of the fluid velocity.

Figure 7A:
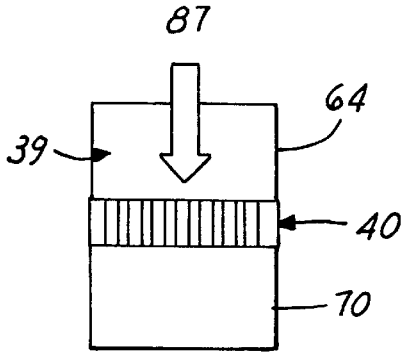
FIG. 7 illustrates split flows of fluid mixture through a preferred embodiment of the intermediate mixing module with axes of orifices parallel to the axis of the main mixing column.

A preferred embodiment of the intermediate mixing module 40 and fluid mixture flow patterns from the module are depicted in FIGS. 7*a,* 7*b,* 7*c.* In the module 40, premixed fluids 87 are split into a plurality of streams by orifices 88 drilled or otherwise machined in the plate 90 installed inside the middle section 39 of the main mixing column 28. Provided that the flow of each individual split stream is turbulent, the fluid inside an orifice contracts accelerating the flow. The split flow acceleration causes vortices 91 in the fluid surrounding fluid jet exiting the orifice. To promote useful fluid contraction, orifice edges should be made sharp. It is preferable to make orifices 88 cylindrical because if the orifices 88 converge downstream, the fluid contraction diminishes, and if, to the contrary, the orifices 88 diverge downstream the split stream, flow velocity is reduced and vortices around fluid jets become weaker, thus decreasing mixing intensity. The diameter of the orifices 88 should not be too small to prevent clogging, which may exacerbate problems with maintenance cleaning.

Other embodiments of the intermediate mixing module may include using a multiplicity of plates, each plate being made like plate 90 with varying spaces between adjacent plates. Because addition of the plates increases pressure drop, the number of the plates employed in the intermediate mixing module 40 should preferably be minimal.

If more than one plate is used, the orifices in one plate could be offset relative to orifices of another plate in order to achieve better mixing in the spaces between plates. Again, this arrangement, though producing higher mixing quality, may result in an excessive pressure drop.

Figure 7B:
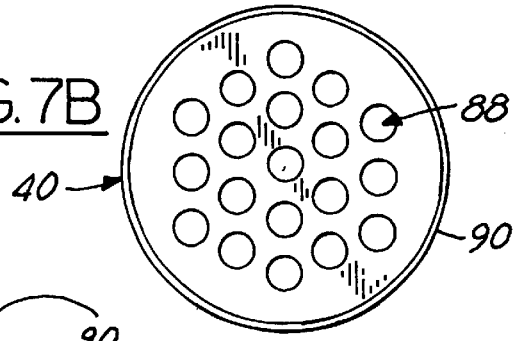
Figure 7C:
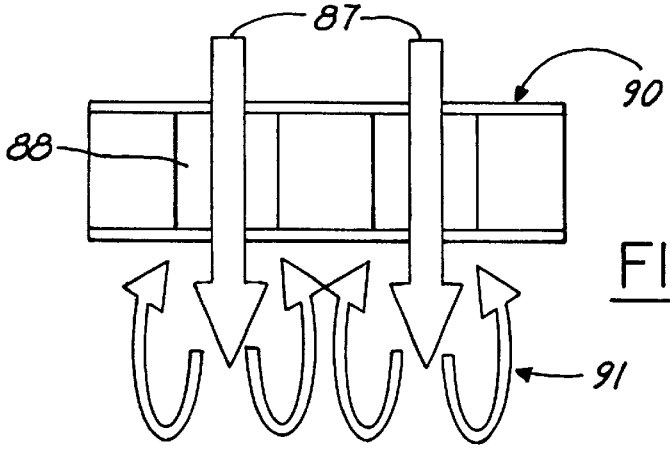
Figure 8A:
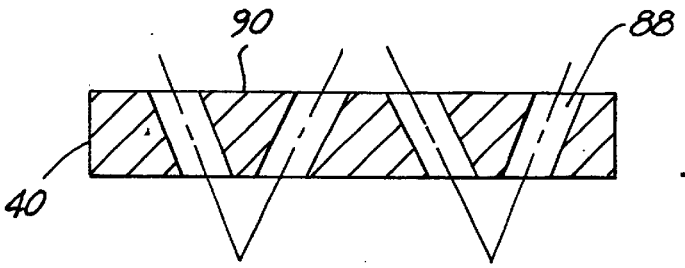
FIG. 8 illustrates another embodiment of the intermediate mixing module with inclined axes of orifices.
Figure 8B:
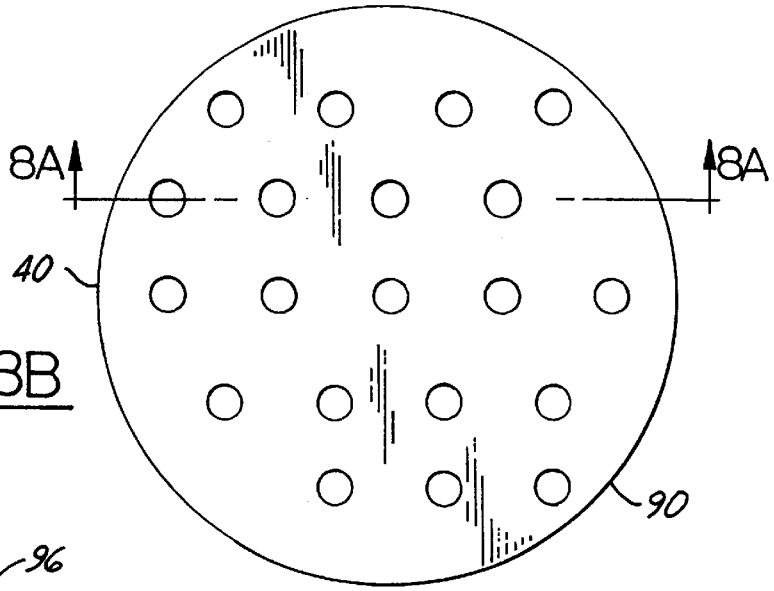
Figure 9A:
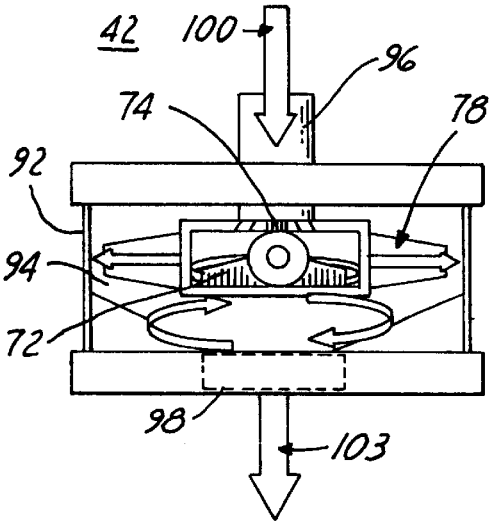
FIG. 9 is detailed vertical and top cross-sectional views of the outlet mixing head and an isometric projection of the central conical distributor therefore.
Figure 9C:
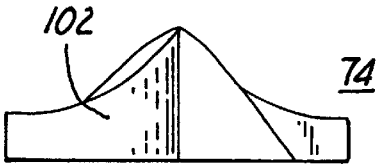
Figure 9B:
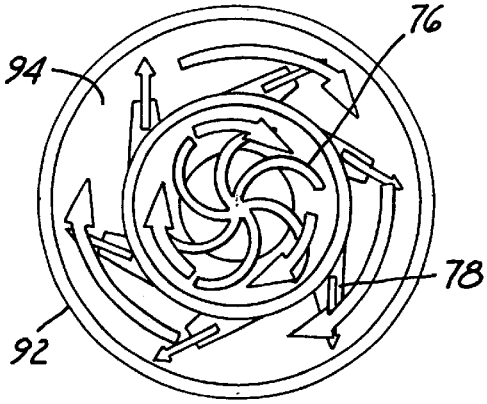

As can be seen from FIG. 7*c,* axes of the orifices 88 are essentially perpendicular to the surface of the plate 90. In FIGS. 8*a,* 8*b,* where another embodiment of the intermediate mixing module 40 is depicted in top and cross-sectional views, they are shown inclined to the surface of the plate 90. Though the angle can be between 30° and 60°, preferably it is about 45°, and the configuration of the orifices 88 is arranged in such a way that each row of orifices has the same angle of axis inclination while signs of angles of adjacent rows are opposite, thus inducing jet collisions in addition to creating vortices between jets. Though the jet collisions enhance mixing, they may also weaken the effect of vortex mixing in the jet divergence zones. In some applications, inclined orifices can provide better mixing because of additional jet collisions, but in most applications the straight orifices 88, as shown in FIG. 7, are preferable because they better use vortex effect in mixing and cheaper in manufacturing.

A preferred embodiment of the outlet mixing module 42 with fluid mixture flow patterns is shown in FIGS. 10*a,* 10*b,* 10*c,* the latter representing an isometric projection of the central conical distributor 74. The design of the outlet mixing module 42 is very similar to that of the inlet mixing module 30 shown in FIG. 4, but not exactly the same. There is certain distinction between them resulting from the manner the fluids or their mixture enter a module. In the inlet mixing module 30, one fluid, 27, enters the module through a single inlet 26, and another fluid, 62, simultaneously comes in through a plurality (at least two) of tangential conduits 38. In the outlet mixing module 42, a mixture 96 enters the module through the single inlet pipe 93. This difference in fluid entering tells on changing the intensity of fluid swirling. Generally, the swirling is more intense in the inlet mixing module than in the outlet one. Usually, there is no need for high swirling intensity in the outlet mixing module because fluids are already thoroughly premixed before entering the module. If there is a need in more thorough mixing, at least one additional intermediate mixing module could be installed. This flexibility further demonstrates the advantages of modular design employed in the present invention.

A main body 92 of the outlet mixing module 42 comprises a chamber 94 with an inlet 96 and outlet 98. A mixture 100 is fed through the inlet 96 onto the central conical distributor 74. The distributor comprises a plurality of concave chutes 102. The preferred chute profile is a concave lemniscate but any other smooth profile could be used provided it reduces the impingement of fluid onto the surface of the main body of the outlet mixing head. The number of chutes 102 is equal to the number of spaces between curvilinear vanes 76 the mixture 100 is being directed into.

The curvilinear vanes 76 are either manufactured by sheet metal forming, forging, or melting together with the outlet mixing module's mixing head 72, or machined in the head 72, or attached to it by any suitable means e.g. welding. The entry angle of the vane 76 closest to the central conical distributor 74 should be such that the fluid flowing downward from the chute 102 be received without a shock. The angles along vane 76 change continuously. They are determined by compounding the radial and the tangential components of the fluid velocity and therefore could be determined by the fluid throughput and required pressure drop.

The mixture discharges into jets 78. The latter are tangential to the mixing head 72 to provide an angular momentum that causes fluid to swirl. The jets 78 are conical with the ratio of outlet to inlet diameters being between 1:1.5 and 1:15, preferably 1:6. The number of jets 78 is preferably equal to the number of spaces between vanes 76, however it could be more or less depending on the requirements to the value of tangential component of the fluid velocity.

A homogeneous mixture 103, the final result of mixing, is discharged from the outlet 98. The diameter of the outlet 98 is smaller than the diameter of the main body 92 of outlet mixing module 42 in order to create a converging flow zone inside the chamber where the fluid being mixed is accelerated, to further enhance the quality of mixing. The ratio of the diameter of the outlet 98 to the diameter of the outlet mixing module's main body 92 is between 1:1.5 and 1:10, preferably 1:4. (Also, direction baffles could be installed within the chamber guiding the flow to the outlet and eliminating stagnant zones. It should be appreciated, however, that the installation of baffles may increase the initial cost of the mixer and introduce additional surfaces to be cleaned.)

Presented below is a functional diagram of an example of the use of the present invention in the slurry—solvent mixing for the chemical mechanical planarization application. In the present deep submicron environment characteristic for the semiconductor chip manufacturing industry, chemical mechanical planarization becomes an essential process in achieving high density of integration of integrated circuits on the semiconductor chip. In this process, slurries, e.g. tungsten slurries, are used as an abrasive material for providing the planarization of a wafer.

The slurry is normally delivered by a commercial supplier in a preset concentration, which must be diluted at the factory by solvent such as ultra pure deionized water. A slurry mixer must blend slurry in large volumes to a tool specific blend ratio. To provide rapid reliable mixing, large volumes of slurry and solvent mixer should be very efficient.

Figure 10:
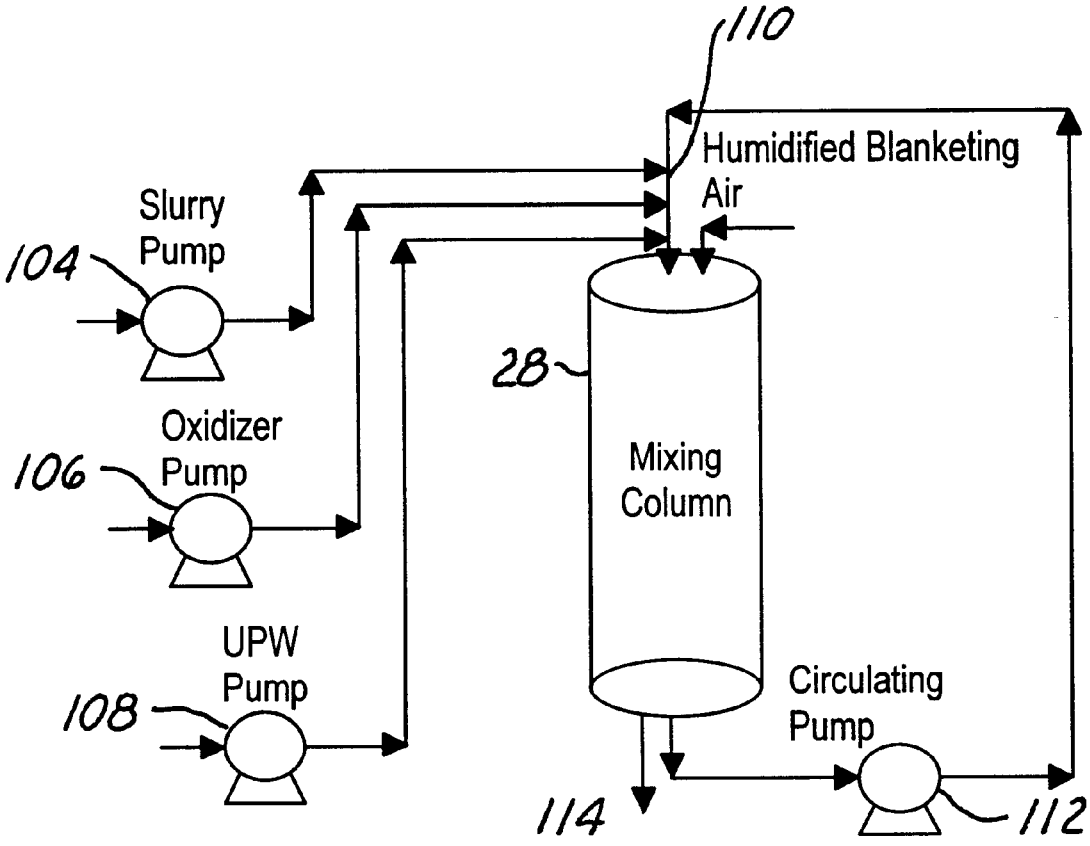
FIG. 10 is a schematic diagram showing the mixing column together with associated elements and illustrating flows of fluids particularly for chemical mechanical planarization application.

FIG. 10 diagrammatically represents an example of using the mixing column 28 of the sent invention for slurry—solvent mixing for chemical mechanical planarization. The mixing column 28 comprising inlet, intermediate, and outlet modules (not shown) receives a slurry solution pumped by a slurry pump 104, oxidizer solution pumped by an oxidizer pump 106, and ultra pure deionized water pumped by a water pump 108. Simultaneously, a portion of mixed slurry is returned to an input feeder 110 by a recirculating pump 112. Through an outlet 114, mixed slurry is discharged to a tool comprising wafer holder and polishing pad (both are not shown) where wafer polishing takes place.

It is to be understood that in all of the applications, power consumption should be reduced as much as possible. It is proportional to the product of flow rate, pressure drop, and time. The flow rate multiplied by time is a quantity of fluid used in the process. This quantity is usually a preset value. For example, in the above-described chemical mechanical planarization it is generally known beforehand how much tungsten slurry is required for polishing a wafer.

Though the present invention has been fully described in the foregoing preferred embodiments and their alternatives, it is to be clearly understood that various modifications apparent to those skilled in the art can be made without departing from the spirit and scope of the invention. All of these modifications are therefore construed as being covered by the claims that follow.

What is claimed is:

1. A static mixer, comprising a mixing chamber with an inlet mixing module at the top of said chamber, fluids to be mixed being fed into said inlet mixing module to undergo swirling and jet collision therein, said inlet mixing module includes a main body defining a chamber with an inlet for a first fluid, an inlet for a second fluid, and an outlet, and a first conduit for supplying said second fluid to said chamber, said first conduit being placed tangentially relative to said main body, said main body comprises a mixing head placed within said chamber and a conical distributor installed thereon, at least one intermediate mixing module connected to said inlet mixing module, receiving premixed fluids therefrom, and provided with means for splitting liquid flow into a plurality of jets with subsequent recombination of said jets and mixing action of vortices formed around said jets, and an outlet mixing module located at the bottom of said chamber, connected to said at least one intermediate mixing module, receiving further premixed fluids therefrom, and provided with means for swirling said further premixed fluids, a resulting mixture of said fluids being discharged from said outlet mixing module.

2. The static mixer according to claim 1, further including means for returning at least a part of said further premixed fluids from a zone between said at least one intermediate mixing module and said outlet mixing module back to said inlet mixing module.

3. The static mixer according to claim 1, wherein said distributor includes curved chutes, and said mixing head comprises curvilinear vanes, installed therein and extending from a common center, and jets, the number of said chutes being equal to the number of spaces between said vanes, said chutes being in fluid communication with said spaces, and said jets outwardly tangentially projecting from said mixing head into said chamber at zones adjacent to said spaces, whereby a direction of flow of said second fluid out of said first conduit into said chamber is close to perpendicular to a direction of flow of said first fluid exiting from said mixing head into said chamber through said jets, to thereby cause vigorous mixing of said first and said second fluids.

4. The static mixer according to claim 1, further comprising a second conduit for supplying said second fluid, said second conduit being similar to said first conduit, placed tangentially relative to said main body, and offset by 180° relative to said first conduit.

5. The static mixer according to claim 4, wherein said first and said second conduits are made integral parts of said main body.

6. The static mixer according to claim 4, wherein a cross-section of said first and said second conduits decreases toward said main body to thus provide acceleration to said second fluid.

7. The static mixer according to claim 1, wherein said means in said intermediate mixing module includes at least one plate with orifices to divide said premixed fluids into jets to thus enhance mixing.

8. The static mixer according to claim 7, wherein said intermediate mixing module includes a plurality of plates.

9. The static mixer according to claim 8, wherein a space between adjacent plates of said plurality of plates varies.

10. The static mixer according to claim 9, wherein said orifices in one plate of said adjacent plates are offset relative to said orifices in another plate of said adjacent plates.

11. The static mixer according to claim 7, wherein axes of said orifices are perpendicular to a surface of said at least one plate.

12. The static mixer according to claim 7, wherein axes of said orifices are made inclined at angle of between about 30° and about 60° to a surface of said at least one plate and orifices are arranged in rows, each of said rows having the same angle of orifice axis inclination, signs of angles in adjacent rows being opposite.

13. The static mixer according to claim 12, wherein said angle is about 45°.

14. The static mixer according to claim 1, wherein said means in said outlet mixing module includes a main body defining a chamber with an inlet for said further premixed fluids and an outlet.

15. The static mixer according to claim 14, wherein said main body comprises a mixing head placed within said chamber and a conical distributor installed thereon.

16. The static mixer according to claim 15, wherein said distributor includes curved chutes, and said mixing head comprises curvilinear vanes, installed therein and extending from a common center, and jets, the number of said chutes being equal to the number of spaces between said vanes, said chutes being in fluid communication with said spaces, and said jets outwardly tangentially projecting from said mixing head into said chamber at zones adjacent to said spaces.

17. A static mixer, comprising a mixing chamber with an inlet mixing module at the top of said chamber, fluids to be mixed being fed into said inlet mixing module to undergo swirling and jet collision therein, least one intermediate mixing module connected to said inlet mixing module, receiving premixed fluids therefrom, and provided with means for splitting liquid flow into a plurality of jets with subsequent recombination of said jets and mixing action of vortices formed around said jets, and an outlet mixing module located at the bottom of said chamber, connected to said at least one intermediate mixing module, receiving further premixed fluids therefrom, and provided with means for swirling said further premixed fluids, a resulting mixture of said fluids being discharged from said outlet mixing module, wherein said inlet mixing module includes a main body defining a chamber with an inlet for a first fluid, an inlet for a second fluid, and an outlet, and a first conduit and a second conduit for supplying said second fluid to said chamber, said first conduit and said second conduit being similar to each other, placed tangentially relative to said main body and offset relative to each other by 180°, a cross-section of said first and said second conduits decreasing toward said main body, said main body comprising a mixing head placed within said chamber and a conical distributor installed thereon, said distributor including curved chutes, and said mixing head comprising curvilinear vanes, installed therein and extending from a common center, and jets, the number of said chutes being equal to the number of spaces between said vanes, said chutes being in fluid communication with said spaces, and said jets outwardly tangentially projecting from said mixing head into said chamber at zones adjacent to said spaces, wherein said means in said intermediate mixing module includes at least one plate with orifices to divide said premixed fluids into jets to thus enhance mixing, axes of said orifices being perpendicular to a surface of said at least one plate, and wherein said means in said outlet mixing module includes a main body defining a chamber with an inlet for said further premixed fluids and an outlet, said main body comprising a mixing head placed within said chamber and a conical distributor installed thereon, said distributor including curved chutes, and said mixing head comprising curvilinear vanes, installed therein and extending from a common center, and jets, the number of said chutes being equal to the number of spaces between said vanes, said chutes being in fluid communication with said spaces, and said jets outwardly tangentially projecting from said mixing head into said chamber at zones adjacent to said spaces.

18. A static mixer, comprising a mixing chamber with an inlet mixing module at the top of said chamber, fluids to be mixed being fed into said inlet mixing module to undergo swirling and jet collision therein, at least one intermediate mixing module connected to said inlet mixing module, receiving premixed fluids therefrom, and provided with means for splitting liquid flow into a plurality of jets with subsequent recombination of said jets and mixing action of vortices formed around said jets, an outlet mixing module located at the bottom of said chamber, connected to said at least one intermediate mixing module, receiving further premixed fluids therefrom, and provided with means for swirling said further premixed fluids, a resulting mixture of said fluids being discharged from said outlet mixing module, and means for returning at least a part of said further premixed fluids from a zone between said at least one intermediate mixing module and said outlet mixing module back to said inlet mixing module.

* * * * *